US010891830B2

(12) United States Patent
Johnston et al.

(10) Patent No.: US 10,891,830 B2
(45) Date of Patent: Jan. 12, 2021

(54) GAMING DEVICES AND SYSTEMS FOR PRESENTING IMPROVED BLACKJACK TYPE WAGERING GAMES

(71) Applicant: Joni Renee Johnston, Daniels, WV (US)

(72) Inventors: Joni Renee Johnston, Daniels, WV (US); Ofir Ventura, Las Vegas, NV (US); John Jeremy Hemberger, Las Vegas, NV (US)

( * ) Notice: Subject to any disclaimer, the term of this patent is extended or adjusted under 35 U.S.C. 154(b) by 198 days.

(21) Appl. No.: 16/120,973

(22) Filed: Sep. 4, 2018

(65) Prior Publication Data

US 2020/0074810 A1 Mar. 5, 2020

(51) Int. Cl.
*G07F 17/32* (2006.01)

(52) U.S. Cl.
CPC ..... *G07F 17/3293* (2013.01); *G07F 17/322* (2013.01); *G07F 17/3244* (2013.01)

(58) Field of Classification Search
CPC . G07F 17/3293; G07F 17/3244; G07F 17/322
See application file for complete search history.

(56) References Cited

U.S. PATENT DOCUMENTS 4,651,997 A 3/1987 Wood
5,257,810 A 11/1993 Schorr et al.
5,280,915 A 1/1994 Groussman
5,328,189 A 7/1994 Malek
5,566,946 A 10/1996 Parker
5,649,705 A 7/1997 String
5,791,989 A 8/1998 Slinkman
5,823,536 A * 10/1998 Flasch ..... A63F 3/00157 273/292
5,876,283 A 3/1999 Parra et al.
6,164,651 A 12/2000 Webb
6,279,910 B1 8/2001 de Keller
6,296,251 B1 10/2001 Webb
6,328,306 B1 12/2001 Webb
6,345,824 B1 2/2002 Selitzky
(Continued)

OTHER PUBLICATIONS

The Wizard of Odds, "Baccarat", https://wizardofodds.com/games/baccarat/basics/, printed Jan. 4, 2019, 12 pages.
(Continued)

*Primary Examiner* — Kang Hu
*Assistant Examiner* — Thomas H Henry
(74) *Attorney, Agent, or Firm* — Dinsmore & Shohl LLP; Monika L'Orsa Jaensson, Esq.

(57) ABSTRACT

Gaming devices and systems are configured to present a game in which players place a game wager on either a banker hand or a player hand. Initial two card player and banker hands are dealt, and if either or both comprise a blackjack, the outcome of the game and associated wagers is resolved relative to those initial hands. If not, final banker and player hands are completed based upon predefined rules. The outcome of the game and the associated game wagers are then resolved relative to those final hands. In one embodiment, the final hands are resolved in similar fashion to a blackjack game with the winning hand being the one with a point total closest to 21 without going over. One or more side bets may also be available to each player.

14 Claims, 5 Drawing Sheets

(56) References Cited

U.S. PATENT DOCUMENTS

| | | | | |
|---|---|---|---|---|
| 6,406,023 | B1 | 6/2002 | Rowe | |
| 6,588,758 | B1 | 7/2003 | Lee | |
| 6,719,921 | B2 | 4/2004 | Steinberger et al. | |
| 6,798,801 | B2 | 9/2004 | Johnson | |
| 6,802,510 | B1 | 10/2004 | Haber | |
| 6,840,517 | B2 | 1/2005 | Snow et al. | |
| 8,651,932 | B1 | 2/2014 | Pertgen et al. | |
| 2006/0151954 | A1* | 7/2006 | Silverman | A63F 1/00 273/292 |
| 2009/0179378 | A1* | 7/2009 | Amaitis | A63F 3/00157 273/292 |
| 2009/0305761 | A1* | 12/2009 | Jackson | G07F 17/32 463/12 |

OTHER PUBLICATIONS

Bo Zarach, Dragon Bonus—Commission Free, Gambling Commission, Feb. 21, 2018, 25 pgs.

* cited by examiner

GAMING DEVICES AND SYSTEMS FOR PRESENTING IMPROVED BLACKJACK TYPE WAGERING GAMES

FIELD OF THE INVENTION

The present invention relates to methods of presenting and playing games, and devices and system which are configured to present games.

BACKGROUND OF THE INVENTION

Blackjack is a very popular table game. One downside to blackjack, however, is that it can be a relatively slow game to play in a multi-player format. In particular, each player must be dealt a separate player hand to play against the dealer, and each player must make their own decisions regarding whether to "hit" (take one or more additional cards) or "stand" (take no more cards) in finalizing their hand. The outcome of the game must then be analyzed for each player by separately comparing each player's hand to the dealer's hand.

Also, blackjack offers less player comradery and social interaction than some other games because each player plays their own hand against the dealer. In this configuration, each player has little or no interest in other player's actions or the other player's hands.

Gaming devices and games which overcome the above-stated disadvantages are desired.

SUMMARY OF THE INVENTION

Embodiments of the invention comprise methods of playing and presenting games and gaming devices and systems for implementing the game.

In one embodiment of the invention, gaming devices or systems are uniquely configured to present a wagering card game to one or more, and preferably a plurality, of players. Each player places a wager upon either a banker hand or a player hand. An initial two card banker hand and an initial two card player hand are then dealt, such as from a card shoe of a plurality of decks of physical playing cards.

If either or both the initial player hand and initial banker hand comprise a blackjack (e.g. a two card count of 21), then the outcome of the game is resolved relative to those hands. If the initial banker hand but not the initial player hand comprises a blackjack, the banker hand is declared to be winning and winnings are paid to players who wagered upon the banker hand (and players who wagered upon the player hand preferably lose their wagers). If the initial player hand but not the initial banker hand comprises a blackjack, the player hand is declared to be winning and winnings are paid to players who wagered upon the player hand (and players who wagered upon the banker hand preferably lose their wagers). If both the initial player hand and initial banker hand comprise a blackjack, the outcome of the game is declared to be a push and all player game wagers are returned.

If neither the initial banker hand or initial player hand comprise a blackjack, none, one or more additional cards are dealt to each hand according to predefined rules in order to form a final banker hand and a final player hand. The outcome of the game is then resolved relative to those final hands. In one embodiment, the hand which closest to or equal to 21, without going over, is declared to be winning and if both hands have the same point total, the outcome of the game is declared to be a push. Once again, each player who placed a wager on the winning hand is preferably paid winnings and the game wagers of each player who placed a wager on the losing hand preferably loses their wager.

In one embodiment, one or more optional side bets may be offered. In one embodiment, a player may place a Frog side bet. This side bet is winning if the banker hand is winning, has 3 cards and a point total of 17. Otherwise, the side bet is losing. Winnings are preferably paid to the player if they win the Frog side bet and their Frog side bet is collected if they lose the Frog side bet.

In one embodiment, a player may place (either in additional to a Frog side bet or separately therefrom) a Win By side bet. This side bet is winning if the player's game wager is placed on the winning game hand and the 'spread' or different in points between that winning hand and the losing hand is a predetermined value. Winnings are preferably paid to the player if they win the Win By side bet and their Win By side bet is collected if they lose the Win By side bet.

In one embodiment, the outcomes of the side bets may be resolved after the outcomes of the game wagers are resolved.

In one embodiment, if the final banker hand is winning, has 3 cards and point total of 17, then all players who placed a wager on the banker hand will push (e.g. their banker hand game wagers are returned).

Games of the invention may be played or presented at a unique gaming table. The table may display a gaming table layout which includes a dealer station and player positions, input receiving devices, such as for receiving or detecting the placement of wagers and player inputs such as wheel spin inputs, and one or more electronic video displays. Games of the invention may also be presented at uniquely configured gaming devices or via uniquely configured gaming systems.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise methods of playing and presenting games and gaming devices and systems for presenting games. One embodiment of the invention comprises an improved blackjack type or style games. In one embodiment of the game, each player places a wager on either a banker (or house or dealer) hand, or a player hand, but not both. An initial two card banker hand is dealt and an initial two card player hand is dealt. If either or both of the initial banker and player hands has a blackjack (e.g. a two-card point total of 21), then the game ends and each player's wager is resolved. If neither the initial banker or player hand comprises a blackjack, then the initial banker and player hands are then completed in accordance with one or more predefined criteria or rules. The outcome of the game is then determined in blackjack game fashion to determine whether the final banker or player hand is winning, and each player's wager is then resolved. In one embodiment, one or more optional side bets are also permitted, and those side bets are resolved, such as with reference to the final banker hand or the final banker and final player hands.

Figure 1:
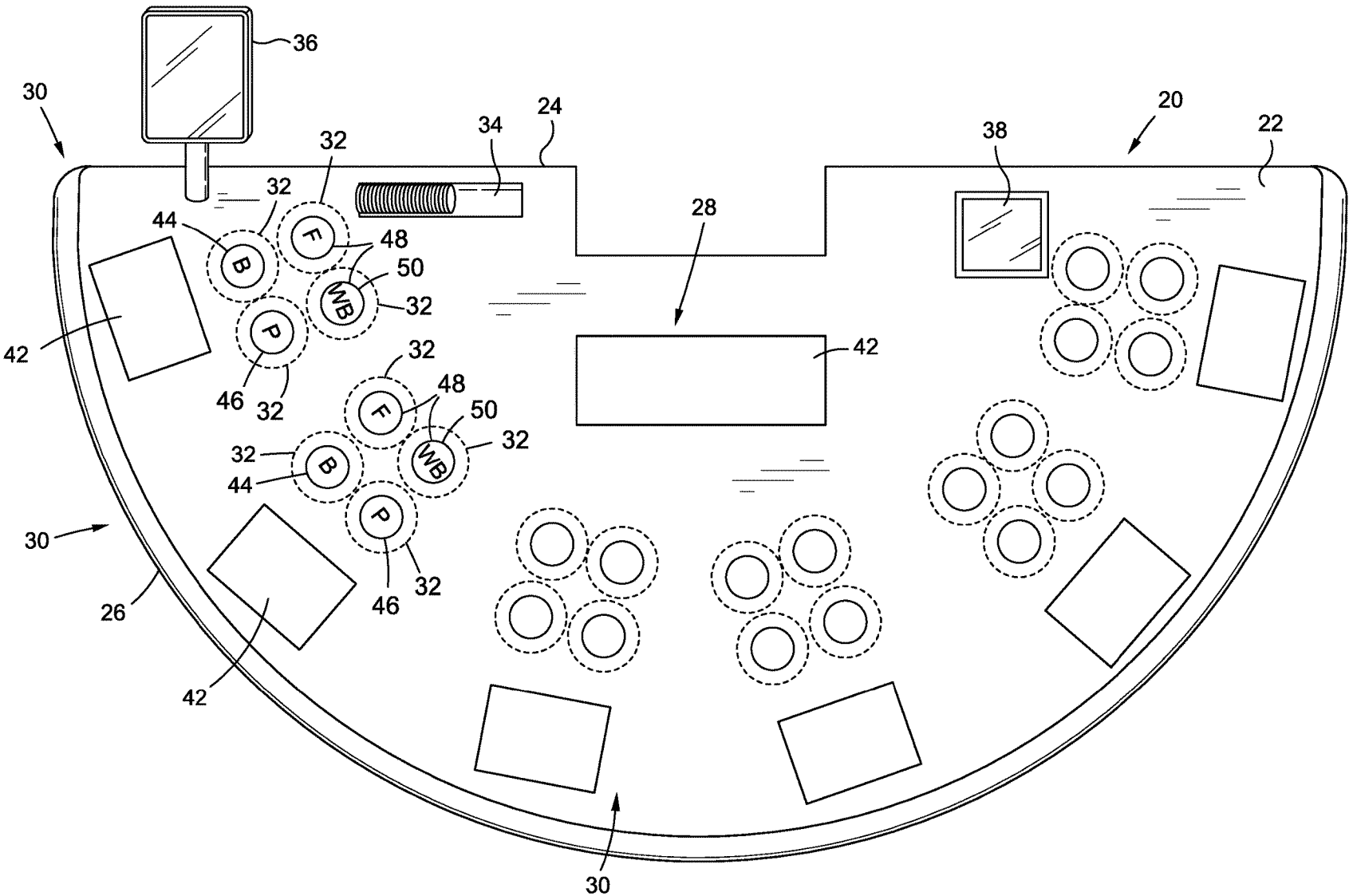
FIG. 1 illustrates one embodiment of a game table and associated game layout for playing and presenting a game of the invention.

In a preferred embodiment, the methods of game play and presentation are implemented relative to a gaming table. One embodiment of a gaming table in accordance with the invention will be described with reference to FIG. 1. As illustrated in FIG. 1, a game playing surface, such as a gaming table 20, is provided. The gaming table 20 defines a top or playing surface 22. The gaming table 20 may include one or more supports, such as a base, legs or the like (not shown) via which the playing surface 22 is elevated above a supporting surface such as a gaming floor.

The shape of the playing surface 22 may vary. In one embodiment, the gaming table 20 has a rear having a rear edge 24 which is generally straight and has an opposing front having a front edge 26 which is generally arcuate. A bumper or cushion may be located at either or both edges 24,26.

In one embodiment, the playing surface 22 is generally planar. However, the playing surface 22 could have one or more raised areas and/or one or more depressed areas or other features which are integrated into the table or added to the table, such as by being located on or mounted to the top surface thereof. Various game-related information or features are preferably associated with the gaming table 20. In one embodiment, the playing surface 22 comprises a gaming felt or similar element(s) which are located over a substrate, such as a planar support. The gaming felt may bear game play information or other information, such as by printing on the felt. This information may vary, such as depending upon the game or games which are to be implemented at the gaming table 20. For example, as indicated above, printing on the gaming felt may comprise one or more pay tables, card locations 42 (e.g. one or more designated areas at or into which one or more cards may be dealt) and the like.

In one embodiment, the configuration of the gaming table 20, such as via elements which are associated with the table 20 and information printed on the gaming felt, defines a dealer station 28 where a dealer may run a game, and one or more player positions 30. The dealer station 28 is generally located at the rear edge 24 and the player positions 30 are located opposite the dealer station 28 at the front or front edge 26. The dealer may, for example, stand at the rear of the table adjacent to the dealer station 28. A player may stand or sit adjacent to each player position 30 at the front of the gaming table 20.

In one embodiment, the game which is presented at the gaming table 20 comprises a wagering game. Wagers may be placed using physical gaming chips or other elements. In one embodiment, the gaming table 20 may define a banker hand wagering area 44 and a player hand wagering area 46 at each player station 30, and a player may place a wager by placing one or more chips at one of those wagering areas 44, 46. In one embodiment, these wagering areas 44,46 may be used by a player to place a wager on either a banker hand or a player hand, as described in more detail below.

In addition, the gaming table 20 may define a Frog side bet wagering area 48 and/or a Win By side bet wagering area 50 at each player station 30. As described below, a player may optionally place one or more chips at one or both of these side bet wagering areas 48,50 in order to be entitled to participate in a side bet opportunity of the game.

In another embodiment, wagers by players may be sensed by detecting the association of one or gaming chips (or monies or other wagering implements) with one or more input receiving devices or input sensors 32. The input receiving devices or input sensors 32 might comprise buttons (wired or wireless), or other input devices, but preferably comprise proximity sensors. The input receiving devices 32 may be located in or on the gaming table 20 and are configured to detect inputs, such as provided by players at the playing surface 22. In the case of proximity sensors, the sensors may be any type of proximity sensor now known or later developed, such as IR, acoustic, capacitive, or the like. In other embodiments, other types of sensors might be utilized, such as RFID or the like. For example, the input receiving devices 32 might comprise capacitive type sensors such as Lanbao CR30S series capacitive sensors (produced by Shanghai Lanbao Sensing Technology Co.; www.shlanbao.cn), which sensors behave as standard electrical 4-pin switches where the switch status changes when a chip (or another object, such as a player's hand) is placed on it. In another embodiment, the input receiving devices or sensors 32 might comprise a light sensing device which measures the distance between the sensor and a chip (or other object, such as a player's hand), such as the VL6180X ambient light sensing proximity sensor produced by STMICRO (www.st-.com).

In one embodiment, one or more input receiving devices 32 are associated with each player position 30, thereby providing a means for each player to provide input relative to game play at the gaming table.

In one embodiment, the dealer station 28 may include one or more chip trays 34 which are located on or at the gaming table 20 for storing chips which may be used to pay player winnings and/or in which chips which were used by players to place wagers may be collected.

In one embodiment, the gaming table 20 may include a number of other features. For example, the gaming table 20 may include one or more table displays 36. The table display 36 may comprise an electronic video display (such as an LCD, LED, OLED, DLP or other types of displays which are now known or later developed) or might even comprise a mechanical and/or electro-mechanical display device such as one or more spinning wheels or reels. The table display 36 may be located at or near the gaming table 20 for use in displaying game related information such as pay table information, game status information, game outcome information, bonus information or the like. The table display 36 might also be used to display promotional information or advertising. In one embodiment, the table display 36 displays the payouts for winning side bet outcomes of the present invention.

The gaming table 20 might also comprise or include various input devices and/or other display devices. The input devices might include one or more dealer input devices such as one or more buttons or a dealer touchscreen display 38. For example, the dealer display 38 might comprise a display which displays game-related information to the dealer and allows the dealer to provide various inputs. Such a touchscreen might comprise a 7" touchscreen from Touchstone Technology, Inc. (www.touchstn.com; Rochester, N.Y., USA).

Of course, various other types of input and display devices might be associated with the gaming table 20. The gaming table 20 might also include player touch-screens, inputs buttons or the like.

Additional details of a gaming table in accordance with one embodiment of the invention will be described with reference to FIG. 2. As illustrated, in this embodiment, elements of the gaming table 20 are associated with or connected to at least one table controller 100. The table controller 100 may be located at the gaming table 20 or may be remote therefrom.

In one embodiment, the table controller 100 comprises at least one processor 102 which is configured to execute machine readable code fixed in a tangible medium (e.g. "software"). The table controller 100 may also comprise one or more information or data storage devices 104. These data storage devices 104 may comprise any type of data storage device such as ROM, RAM, EPROM or the like, as well as mass storage devices such as hard drives. The data storage devices 104 may store various data, including game code or software which is executable by the processor(s) 102 and other data, such as game data including wager data, game outcome data, images, etc.

The table controller 100 preferably includes one or more communication interfaces 106. The communication interface(s) 106 may facilitate wireless and/or wired communications with one or more remote systems or devices in accordance with various protocols (USB, Wi-Fi, Bluetooth, Ethernet, Firewire, etc.). In one embodiment, data or information may be exchanged between the processor(s) 102, data storage device(s) 104 and communication interface(s) 106 via one or more interfaces, such as a system bus 108. Of course, the table controller 100 might have other configurations, including other elements or features.

Figure 2:
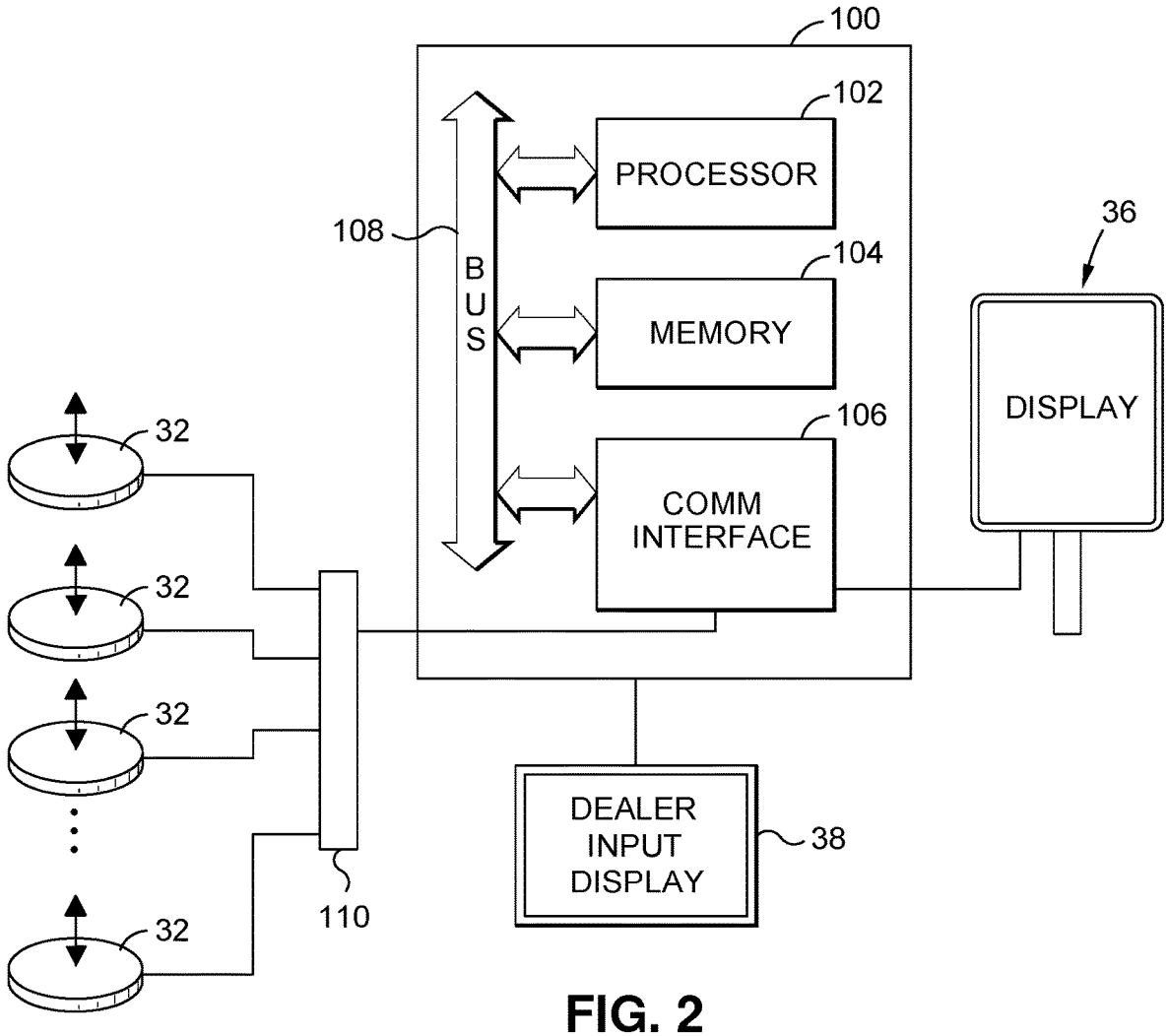
FIG. 2 illustrates a gaming system in accordance with one embodiment of the invention.

As illustrated in FIG. 2, the one or more input receiving devices 32 of the gaming table 20 may be interfaced with the table controller 100 to that the table controller 100 may receive information from those devices 32 and, in some embodiments, to transmit information to those devices. Likewise, the dealer input and/or display devices, such as the dealer touchscreen 38, may be interfaced to the table controller 100. Also, other input and/or display devices such as the table display 36 may be interfaced to the table controller 100.

In one embodiment, the table controller 100 or other devices associated with the gaming table 20 may determine player monetary or chip value balances, including based upon monies associated with the table by the player (such as chips purchased), amounts wagered and amounts won or the like.

The gaming table 20 of the invention may include or be associated with other elements or devices. For example, the gaming table 20 might include other gaming equipment, such as one or more player displays (such as located at each player position and configured to display game information, player tracking information, advertising or other information), card shoe(s), card reader(s), card shuffler(s), player tracking devices (such as for reading a player tracking card or other media of a player for use in tracking the player's game play) and the like. The gaming table 20 might also be connected to external devices. For example, the table controller 100 might be connected to one or more casino servers or systems, such as a casino accounting server which tracks game play at each gaming table 20, such as relative to the amounts of wagers placed and winnings paid to the players, among other information. The gaming table 20 might also be connected to a player tracking server and include player tracking elements such as player card readers.

The gaming system might include other elements, such as input receiving device controllers or the like. In one embodiment, the input receiving devices 32 communicate with a hub or aggregator 110 which communicates with the table controller 100. The hub 110 may be configured to read or determine the status of each input receiving device 32 and provide information to the table controller 100, such as when the status of an input receiving device 32 changes. The hub 110 may also comprise a power source for the input receiving devices 100. As another example, a proximity-type input sensor might be configured as a USB type device having a USB controller. The table controller 100 may be configured to control the proximity device as a USB device. In this regard, the processor 102 and/or one or more sub-processors or controllers may be utilized to control the input receiving devices.

In one embodiment of the invention, different input devices might be utilized for receiving different inputs (such as one input device for receiving a wager input and another input device for receiving a "spin" input or the like). In another embodiment, the one or more input receiving devices 32 are configured to receive multiple inputs. Each input receiving device 32 may be configured to receive two or more inputs. The inputs may be game-related inputs by a player and comprise two or more different types of inputs at two or more different times.

In one or more embodiments of the invention, aspects of the input receiving devices 32 and/or other devices or elements may be controlled or utilized to facilitate the receipt of the different player inputs. For example, the input receiving devices 32 and/or the table controller 100 may be configured to control the receipt of inputs, such as by selectively activating and deactivating the input receiving devices 32 so that they will receive input at certain times, but not others. In other embodiments of the invention described below, the configuration of the input receiving devices 32 may change to facilitate the input(s), such as by changing a detecting sensitivity to detect an intended player input from an unintended input. In yet other embodiments described herein, one or more secondary elements, such as audible and/or visual indicators may be used in conjunction with the input receiving devices 32 to facilitate the input receiving functionality of the input receiving devices 32.

In one example embodiment of the invention, such as disclosed in more detail below, a wagering game may be presented at the gaming table 20. The game may have a base game and one or more side bet portions. For example, the base game portion may comprise a card game which is played with one or more decks of physical playing cards. The side bet portion may comprise a determination of whether the player has won a side bet, if so, the award side bet winnings. As detailed herein, however, other types or configurations of games which require player input may be implemented relative to the invention.

In one embodiment, the input receiving devices 32 may be turned off or be configured to not receive inputs except during designated times. This prevents, for example, inadvertent inputs from being received when games are not being presented or when other activities are occurring. For example, it may be preferable for the input receiving devices 32 to not receive inputs between games or during certain portions of a game.

In one embodiment, the input receiving devices 32 may be turned off by providing an instruction to them to not receive or transmit inputs. In other embodiments, the table controller 100 could be configured to ignore input signals from the input receiving devices 32.

In one embodiment, the input receiving devices 32 may be "activated", such as by turning them on or by causing the table controller 100 to be configured to receive inputs from the input receiving devices 32. This step may be implemented by a dealer, such as by input to the one or more dealer input devices. For example, the dealer display 38 might display a "start game/receive wagers" button which the dealer may select. In response to that input, the table controller 100 may be configured to receive inputs from the input receiving devices 32 or may send control instructions to those devices to cause them to be activated.

After activation, one or more first inputs may be provided to the one or more input receiving devices 32. This may comprise, for example, a first type of input such as a wager input, such as via the detection of one or more chips.

Figure 3A:
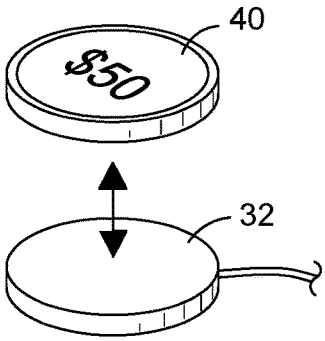
FIGS. 3A and 3B illustrate first and second inputs to an input receiving device in accordance with the present invention.

In one embodiment, a wager input may be provided by a player placing one or more chips 40 on or adjacent to a particular input receiving device 32, such as illustrated in FIG. 3A. At that time, the wager input(s) may be detected by those devices 32 and may be transmitted to the table controller 100 for processing. Wager information may be displayed to the dealer, such as via the dealer display 38. The dealer might then collect the wagers and place the wagered chips in the chip tray 34.

In one embodiment, after a first input period, the input receiving devices 32 may again be de-activated. Once again, this may comprise a dealer providing input to the dealer input device(s), such as the dealer touchscreen 38. For example, the dealer touchscreen 38 might display a "close wager" button which the dealer may select. This may cause the table controller 100 to no longer receive inputs from the input receiving devices 32 and/or to send a control instruction to those devices to de-activate them.

At one or more times, the input receiving devices 32 may be configured to receive one or more additional or second inputs, such as other inputs or wagers. One or more of the secondary inputs may comprise a different type of input than the first input. In order to receive the at least one secondary input, the input receiving devices 32 may again be re-activated. In one embodiment, only certain input receiving devices 32 may be activated for receiving particular inputs. For example, a player who obtains a side bet winning outcome (as described below) might be permitted to spin a bonus wheel for a jackpot payout. Preferably, the input receiving devices 32 corresponding to only those players who are entitled to spin for a jackpot award might be activated. The input receiving devices 32 relative to the other players preferably remain inactive, such as to prevent accidental input thereto.

Figure 3B:
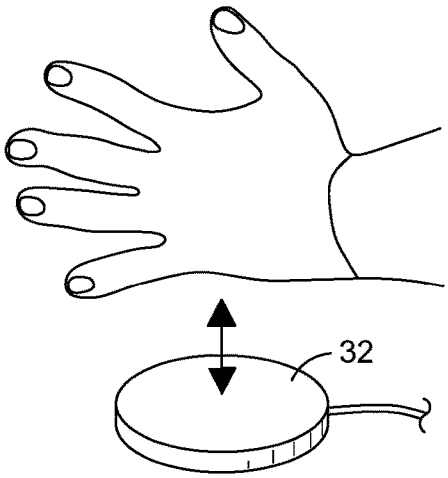

In one embodiment, an input might comprise a player placing their hand, one or more fingers or another body part or the like on or adjacent to the input receiving device 32, or waving their hand across the device, such as illustrated in FIG. 3B (for example, using the above-referenced VL6180X ambient light sensing sensor, the sensor detects the presence of the player's hand proximate to the sensor (by determining a distance of the player's hand from the sensor by determining a flight time of projected light which is reflected from the player's hand back to the sensor) in order to receive the player's hand input). In response, one or more game features or the like may be implemented by the table controller 100 and/or dealer in response to the received input. For example, in response to the detection of a player's hand, an input receiving device 32 may send a signal to the table controller 100. The table controller 100 may then be configured to cause the table display 36 to display the image of a wheel which rotates and then stops at a selected award. This process might be repeated relative to each player who is entitled to spin for a side bet award. In one embodiment, the input receiving device 32 corresponding to a first player is activated and receives an input from that player, the bonus element or other feature is implemented and then that input receiving device 32 may be inactivated. The input receiving device 32 relative to a second player may then be activated, and so on.

Figure 4:
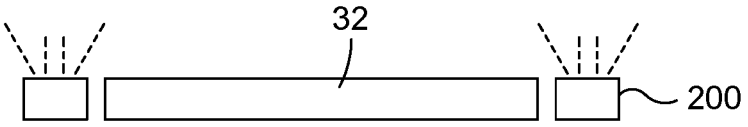
FIG. 4 illustrates an input receiving device having an associated indicator in accordance with one embodiment of the invention.

In one embodiment, the system might include one or more input receiving device indicators. These indicators might comprise, for example, audible and/or visual indicators. The indicators may provide an indication, such as by sound, light (including color), text or the like, of a status of an input receiving device 32 or an activity associated therewith. As one example, a visual indicator such as a color or multi-color light ring 200 might be located around an input receiving device, such as illustrated in FIG. 4. Of course, such an indicator might otherwise be located adjacent to an input receiving device 32 or even over such a device. The indicator lights might be located inside the device if the device is equipped with a translucent surface.

In one embodiment, the indicator(s) might provide an indication or information to a user comprising one or more of: (1) an inactive status of the input receiving device; (2) an active or ready for input status of the input receiving device; and (3) accepted or received input to the input receiving device. In one embodiment, the one or more indicator(s) are controlled in conjunction with the input receiving devices, such as via the table controller.

As one example, when an input receiving device is inactivate, an associated indicator (such as a light ring around the input receiving device) might be illuminated red. When it is active, and ready for a particular input, it might be illuminated flashing green. When an input is received, the flashing green light might transition to a steady green light.

Figure 5A:
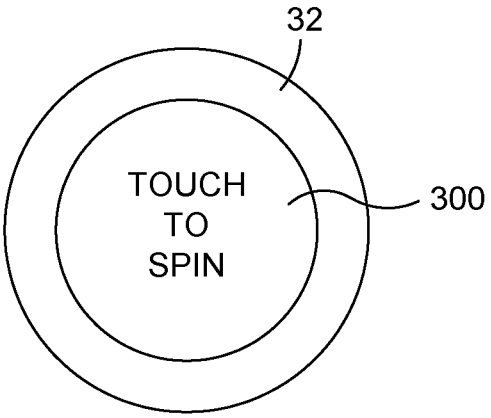
FIGS. 5A and 5B illustrate an input receiving device having an associated indicator in accordance with another embodiment of the invention.
Figure 5B:
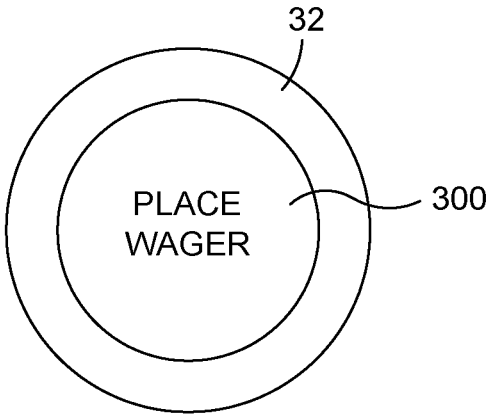

In another embodiment, text or other instructions might be displayed by the one or more associated indicators. For example, as illustrated in FIGS. 5A and 5B, a video screen 300 may be located over or may be located adjacent to an input receiving device 32. The video screen 300 might display "place wager" when the input receiving device is configured to receive a wager (as shown in FIG. 5B) and might display "touch to spin" or other instructions when the input receiving device is configured to receive a player spin input (as shown in FIG. 5A).

Of course, the indicator(s) may have various configurations. Preferably, the indicator(s) are located adjacent to or are associated with (and may even be integrated with) the input receiving device(s) 32.

As one example of the use of an input device where one or more indicators are utilized, an indicator associated with an input receiving device or sensor 32 may be activated to indicate to a player that their input receiving device 32 is ready to accept a wager. This might comprise, as indicated above, causing the indicator to illuminate a flashing green light, to cause a display to show a "place wager" instruction or the like. The input receiving device 32 may then receive an input in the form of one or more chips placed by the player.

The indicators may then be activated to indicate that the wager period is closed. This might comprise, for example, the indicators being illuminated red or displaying a "wagers closed" instruction or the like. Thereafter, such as after various steps of the game, an indicator may be activated to indicate that an associated input receiving device or sensor 32 is ready for a bonus spin input. This may comprise the indicator illuminating a flashing green light, showing a "touch to spin" instruction or the like, as illustrated in FIG. 5A.

In one embodiment, the indicator may be activated to indicate that the input was received from the player. For example, once the input receiving device 32 detected the player input and sent information regarding this input to the table controller 100, the table controller 100 may cause the indicator display a steady green light or to display an "input received" indication. Thereafter, the game feature might then be implemented based upon the player input.

Of course, at a gaming table where multiple players are playing, the indicators may indicate a particular status of an input receiving device corresponding to each player, where the status may vary from player to player. This allows the indicators to provide information to each player which is unique to that player. For example, during an award selection event phase, only the indicator associated with the input receiving device of a player whose turn it is to spin may indicate such (while the indicators associated with the input receiving devices of the other players may indicate that no input is to be provided by those players).

Of course, the indicators may be used in various manners. For example, the indicators might always be activated in a manner which confirms a player input, whether of a wager or a direct input, rather than just a player's direct input. In one embodiment, the status of the indicators may be automatically controlled by the table controller 100 or might be controlled by the dealer, or both. For example, a dealer might provide input which opens and closes a wagering period. When the dealer opens the wagering period, the indicators (via control from the table controller based upon the dealer's input) might indicate that the input receiving devices 32 are ready to receive wagers and when the dealer closes the wagering, the indicators may indicate that no more wagering inputs are being accepted (again as controlled from the table controller based upon the dealer's input).

As indicated herein, in one embodiment, input receiving device(s) 32 may move between active and inactive conditions. While the dealer may provide inputs to the table controller 100 to control input receiving device activation and de-activation, such might be at least partially automated. For example, in response to a dealer selecting a "start game" option, the table controller 100 might activate the input receiving devices 32 for purposes of receiving player wagers. The table controller 100 might automatically close wagering after a certain time, such as 1 minute, by automatically de-activating them.

In another embodiment of the invention, the input receiving device(s) 32 might always be active or might be inactive between games but always active during game play. In this embodiment, in order to reduce chance of inadvertent input to the input receiving devices(s), the indicators described above might be utilized. For example, instead of an input receiving device being truly inactivated, the associated indicator may indicate to a player that they should not provide an input to the device (although if the player did, such an inadvertent input might then still be registered).

In one embodiment, the input receiving device(s) 32 may be controlled to change one or more characteristics thereof, such as a sensitivity of the device. As one example, the table controller 100 or another controller might be used to implement a first input sensitivity of an input receiving device, such as relative to the detection of one or more chips, but another or second input sensitivity at another times. For example, an input sensitivity or similar characteristic might be controlled in order to reduce the chances for inadvertent input to the input receiving device 32, such a player's hand inadvertently passing over or near the device. This feature might be used, for example, to distinguish between a true "spin" input (or other input from the player) which is provided by a player's hand or the like, and an inadvertent passing of a portion of the player's hand or another object near the sensor which is not intended as an input. As another example, the input receiving device 32 might be configured to require an input of a length of time, such via detection of a player's hand adjacent to the input receiving device(s) for a period of time which would essentially avoid in inadvertent input from being logged. This type of input receiving device control, particularly relative to a proximity sensor, has particular applicability to the invention where the game may require multiple inputs from a player, including different types of inputs, during different times of the game.

Additional details of methods, devices and systems of the invention will now be described. Another aspect of the invention comprises a method of presenting and playing a game. In a preferred embodiment, the game is played between one or more players and a dealer or the house. In one example embodiment of the invention, the method may be implemented relative to a gaming table. The gaming table might comprise the gaming table 20 described above, such as including the various input receiving devices 32, table display 36 and other features, or it might comprise a gaming table which does not include some or all of such features, or might include other features.

Figure 6:
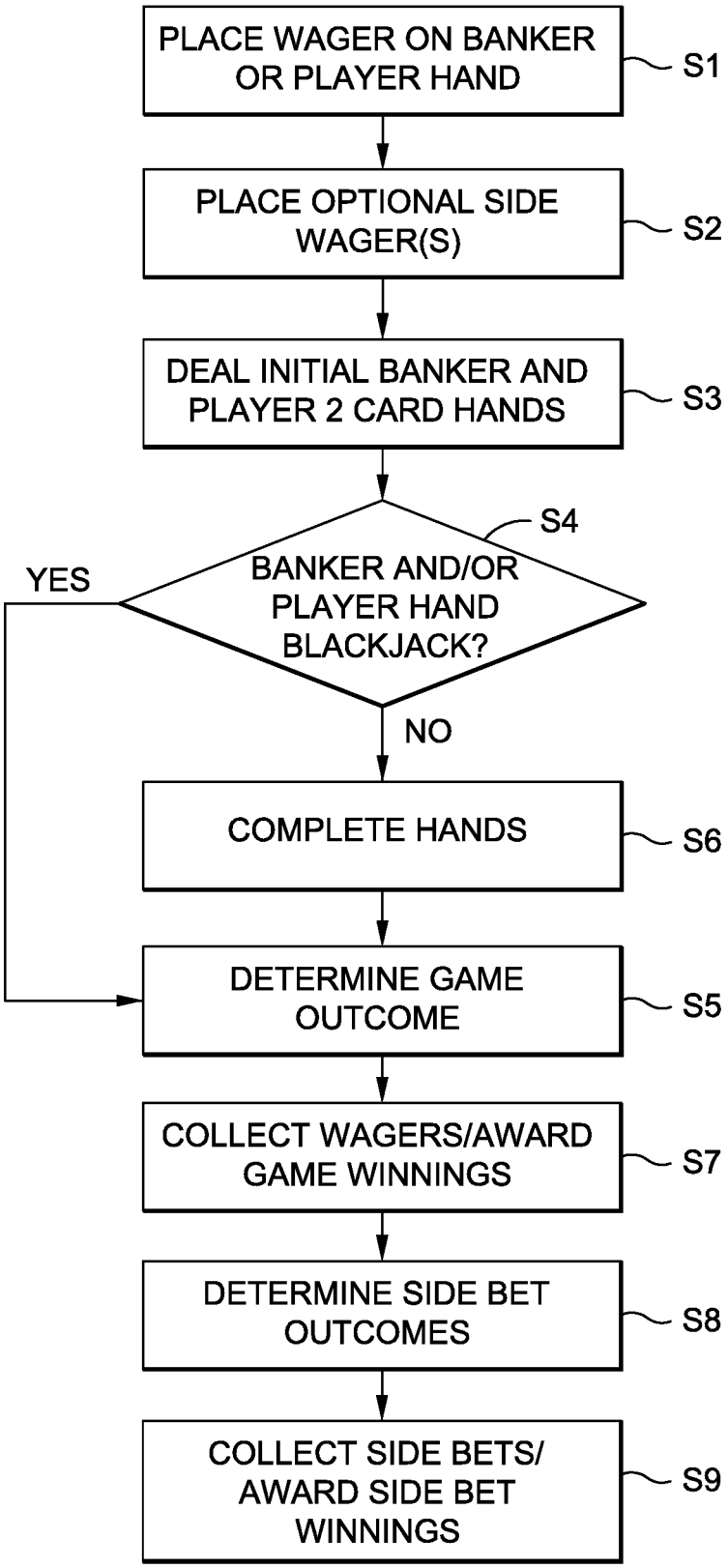
FIG. 6 is a flow chart which illustrates one method of playing and/or presenting a game in accordance with the invention.

FIG. 6 is a flow diagram which illustrates a method of presenting and playing a game in accordance with one embodiment of the invention. In one embodiment, the game is played by a dealer or the house (which may comprise a live person or a virtual dealer) and at least one player, and preferably a plurality of players. As detailed herein, the game might be played or presented at a gaming machine or device, at a gaming table or the like. In a preferred embodiment, the game is played at a gaming table by a dealer and at least one player, such as up to 7 players or more.

Preferably, the game is presented as a wagering game in which a player is required to place a wager in order to play the game and where the player has the opportunity to be awarded winnings. Thus, in one embodiment, in a step S1, a player places a game wager. As indicated above, the game table 20 may include a banker hand wager location 44 and a player hand wager location 46. In one embodiment, the player must place a wager on either the banker hand or the player hand, but not both. An input sensor 32 may be associated with each of the banker hand and player hand betting locations 44,46 for detecting a wager. In one embodiment, a player places one or more chips, coins or the like at the wager location corresponding to the banker hand or player hand, depending upon which hand the player wishes to wager upon, such as by locating the one or more chips or the like in proximity to the one or more sensors for detection thereby. The game wager may be required to be of a certain minimum size and may also have a maximum size. In one embodiment, the game wager only entitles the player to participate in the base game and not a side bet opportunity. In one embodiment, it is possible for the player to be required to place more than one main game wager, such as an ante and also a play wager.

In a step S2, the player may optionally place a side bet or side wager. As indicated above, the game table 20 may include one or more side bet locations, such as a Frog side bet location 48 and a Win By side bet location 50. If the player does not place a side bet on a particular side bet option, then the player is not eligible to participate in that side bet feature, including winning any side bet award (but the player is still eligible to play the base game and be awarded winnings for a base game win). The side bet might be of varying sizes, such as being required to be at least as much as the base game wager. As detailed below, in one embodiment the player can optionally place a side bet on either or both a Frog side bet and a Win By side bet.

In a step S3, the game is initiated. In a preferred embodiment, the game is played or presented with one or more decks of playing cards, such as cards dealt from one of more decks of standard playing cards (e.g. cards having the rank indicia 2 3, 4, 5, 6, 7, 8, 9, 10, Jack, Queen, King and Ace in each of the four suits Hearts, Clubs, Spades and Diamonds). In one embodiment, the game may be played using 6, 7 or 8 decks of such cards. As described below, the playing pieces may comprise physical playing pieces, such as physical printed cards (such as where card indicium is printed on physical card stock, with the card indicia displayed on one side—a "face" side—of the card and not on an opposing side or "card back"), or might comprise virtual playing pieces, such as graphical images of the playing pieces displayed on one or more electronic video displays.

In a preferred embodiment, an initial two (2) card player hand and an initial two (2) card banker hand are dealt. The cards may be dealt in a variety of manners. In the case of a gaming machine, the cards may be generated via random selection and displayed as video images. In the case of a table, the cards may be dealt (such as by the dealer) from a deck or set of physical playing cards, including from a shoe. In one embodiment, a first card is pulled face down from the shoe and moved to a player hand area to the dealer's right, and then a second card is pulled face down from the show and is tucked under a corner of the card show. A third card is then pulled from the card shoe face down and is moved to the player hand area, and a fourth card is pulled from the card shoe face down and is tucked under the card shoe next to the second card.

The dealer then preferably flips over the two cards which form the initial player hand and the two cards which form the initial banker hand and may announce the card count totals of those hands (e.g. the sum of the card values of the two cards of the initial banker hand and the sum of the card values of the two cards of the initial player hand). In a step S4, it is determined if either or both of the banker hand and the player hand comprise a blackjack (e.g. an Ace and a ten count card for a two card total point value of 21). If so, then the outcome of the game is declared or determined and the game wagers are resolved, as at steps S5, as described in more detail below.

If neither the banker hand or the player hand comprises a blackjack hand, then the banker and player hands are completed at step S6. In one embodiment, the hands are completed in accordance with one or more predefined rules or criteria.

In a preferred embodiment, the dealer acts on the player hand first, according to the following predefined rules (which apply for the card point total of the initial two player card and for the card point total after every additional card is dealt to the player hand):

1. When the player hand has a point total of 2-11 the player hand will always hit (e.g. receive an additional dealt card, such as dealt by the dealer from the cards in the card shoe), wherein if the hand contains an Ace, the Ace will be counted as 1 if the hand total (with the Ace counting as 1) is 6 or less, and will be counted as 11 if the hand total is 7 (with the Ace counting as 1) or greater;

2. When the player hand has a point total of 12-16 the player will:

Hit if the banker hand has a total of 17 or higher; and

Stand if the banker hand has a total of 16 or under

3. When the player hand has a point total of 17 or above, the player hand will stand; and 4. The player hand can only draw out to 4 cards and then must stand, regardless of the point total of those 4 cards.

In one embodiment, the dealer will then act on the banker hand as follows:

1. When the banker hand has a point total of 2-16 the bank hand will always receive a card;

2. When the banker hand has a point total of 17 or higher the bank hand will always stand.

3. When the player hand busts (e.g. has a card count over 21), the banker hand will stand.

4. When the player hand has card count of 21, the banker hand will stand.

5. The banker hand can only draw out to 4 cards and then must stand.

The above criteria are preferably utilized to form a final player hand and a final banker hand.

At step S5, the outcome of the game is determined. If the initial player hand and/or the initial banker hand comprised a blackjack in step S4, then the hand with the blackjack is declared to be the winner. If both the initial banker hand and the initial player hand comprise a blackjack, the outcome is declared to be a push or tie.

If the player and banker hands were completed to final hands in step S6, then the outcome of the game is determined by comparing the card point total of the final player hand to the card point total of the final banker hand, wherein the hand with the highest point total without going over 21, is declared the winner, and hands with the same point total being declared a push or tie, with the exception that in a preferred embodiment, a winning banker hand with a 3 card total of 17 is declared a push as to players who placed a wager on the banker hand.

In step S7, wagers are resolved. In general, when the banker hand is winning, a player who wagered on the banker hand is paid winnings (except as noted above where the banker hand has a three (3) card total of seventeen (17), in which case the player is not awarded winnings but has their wager returned) and the game wagers of players who placed wagers on the player hand are collected. When the player hand is winning, a player who wagered on the player hand is paid winnings and the game wagers of players who placed wagers on the banker hand are collected. When the outcome of the game is a push as to a player, the player's wager is returned.

The amount of winnings which are paid for a winning game wager may vary. For example, if a player places a wager on a winning two card hand (either the initial player hand or the initial banker hand) which comprised a blackjack, the player might be paid winnings in the amount of 3:2 times their wager. On the other hand, if the player placed a wager on a winning final hand (either the final player hand or the final banker hand), then the player might be awarded winnings at 1:1 times their wager. Of course, other amounts might be awarded, either fixed in value or in relation to the amount wagered.

As noted above, in one embodiment, each player may optionally be permitted to place one or more side bets. In step S8, the outcomes of such side bets may be determined.

As noted above, in one embodiment a player may optionally place a "Frog" side bet. This side bet is that the final banker hand is winning and comprises three (3) cards with a point total of seventeen (17). In one embodiment, if a player placed this side bet and the Frog side bet condition is met, then the player is paid winnings at 25:1 times their Frog side bet wager, such as at step S9. If the condition is not met, the player loses their Frog side bet and that side bet is collected.

As noted above, in one embodiment, a player might alternatively or in addition place a "Win By" side bet. The Win By side bet is a wager that that the hand that they wagered upon is winning and wins by a certain point total over the losing hand. For example, the Win By side bet may be that the winning hand exceeds the losing hand by eight (8). In such an example, the player would win their Win By side bet if they wagered on the player hand and the player hand won with a card point total of 21 vs the banker hand card point total of 13 (for a different or "win by" of eight (8)).

The Win By value may be dictated by the house or might vary, such as being randomly selected before each game, or might even be selected by the player. The amount of winnings for a winning Win By side bet might be a fixed value, a ratio of the player's Win By side bet or the like, such as set forth by a pay table.

In other embodiments, winning wagers might be paid as fixed value jackpots or progressive jackpots. For example, winning side bets might be paid as progressive jackpots. Such progressive jackpots might grow over time (until won, at which point they preferably reset back to a starting value), such as based upon the number of games played, time, based upon a portion of the side bets wagered, etc. For example, 95% of the side bets may, on average, be returned to the players by setting the jackpot values (and/or progressive growth values) in combination with the odds of winning the side bets.

Of course, variations of the invention are contemplated. For example, the above-described steps might not be performed in the same order.

In one embodiment, although the game has blackjack game type features, the game does not incorporate many features of standard blackjack. For example, in a preferred embodiment, the player hand cannot be split and players cannot double down their wagers. Likewise, the game does not include a blackjack insurance bet or the like. Importantly, as detailed below, each player is not dealt their own player hand and is not required to wager on their own player hand but may wager upon either the single player hand or the banker/dealer hand.

In one embodiment of the invention, winnings (such as for winning side bet outcomes) might be awarded in manners other than via pay table. For example, the player may be awarded side bet winnings based upon an award selection event such as a spin of an award wheel.

For example, referring to FIG. 1, in one embodiment an award wheel may be displayed graphically on the display 36 at the gaming table 20. Each player who receiving a winning side bet outcome is given the opportunity to spin the wheel. As indicated above, in one embodiment, an input receiving device 32 may be activated. The player may then wave their hand or provide input to the input receiving device 32. The table controller 100 may then cause the display 36 to display a graphical representation of a spinning wheel which stops at a selected segment which corresponds to define the outcome of the wheel spin, and thus indicate the award which is awarded to the player. In such a configuration, the wheel spaces may display various awards, where those awards might vary depending upon the particular winning side bet outcome which the player received.

In one embodiment, the virtual wheel may be configured with segments which have associated awards and the probability of a particular segment being selected may be weighted. In the wheel spin event, a random number generator or the like may be used to generate a random number which is then compared to a lookup table of outcomes. The selected outcome corresponds to a segment having an assigned award. The controller may then cause the display 36 to display a wheel spin in which the wheel stops at the selected segment. In this configuration, certain outcomes or awards are more likely to occur than others Of course, the wheel spin event could be implemented by spinning a physical spinning wheel, such as where the stopping position of the wheel relative to a pointer or other selector is controlled, such as via a motor. The award selection event might also be represented by other than a wheel spin, but by other events.

Winnings (for winning game wagers or side bet wagers) might be paid in the form of chips, electronic credits or the like. The player might cash-out electronic credits to a printed ticket or the like, such as printed and issued by a printer at a gaming table or device. The player might then take that ticket to a cashier station or window for redemption, such as conversion to monetary funds. Likewise, a player might cash out chips in a similar manner.

In one embodiment, another embodiment, the above-reference paytables might be displayed to players using the table display 36. The displayed information might include, for example, current award values (which amounts may change over time and thus be updated over time, such as where the jackpots are progressive). In one embodiment, as noted above, the dealer might use a dealer control, such as the touch screen 38, to activate the base game wagering areas 44,46 and side bet areas 48,50 at the start of the game, so as to receive the bets from the players. If a player obtains a side bet winning outcome, the player might provide an input to the dealer control, such as the touch screen 38, such as to a particular displayed player seat location. The dealer might also provide an input of the particular bonus bet winning outcome, such as from a list of possible winning outcomes, as to each winning player. The dealer might then select a "pending award" button and then a "pay award" button in order to effectuate payment of the award to the winning player (which process may be repeated as to each player who obtains a side bet winning outcome). In one embodiment, the players may be paid electronic credit as their award, while in other embodiments, as noted above, a player might be awarded chips.

It is noted that the steps described above may be applied to each player of the game, and each winning side bet. For example, a player may place a Frog side bet and a Win By side bet and then be allowed to spin a wheel two times to determine an amount of winnings for each of those two winning side bets.

As indicated, the game of the invention may be implemented in various manners, such as via various gaming machines, devices and/or systems. For example, the methods of game play and presentation may also be implemented via a gaming machine or device. Such a gaming machine may have various configurations.

The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 7:
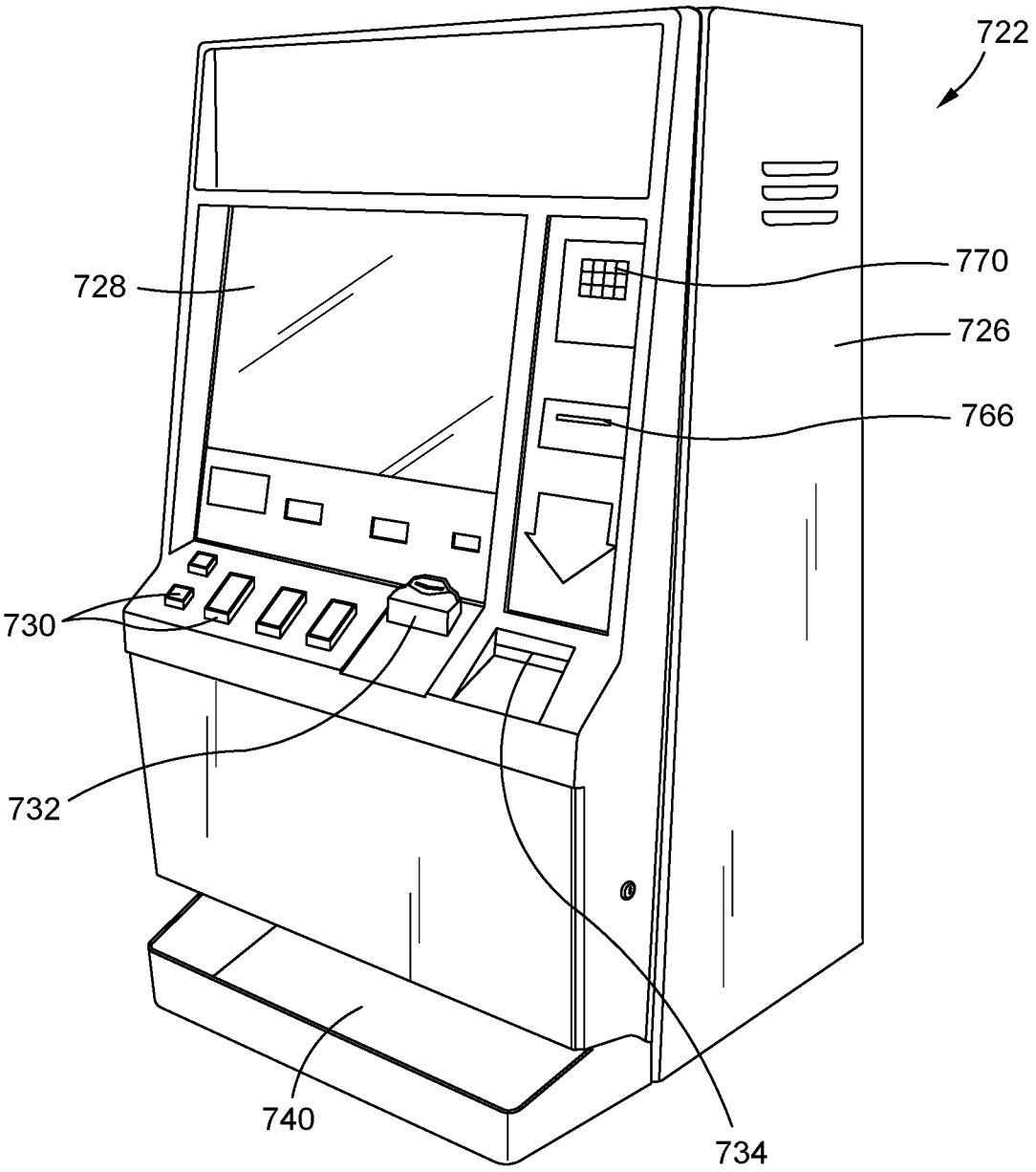
FIG. 7 illustrates one embodiment of a gaming machine for presenting a game in accordance with the invention.

One configuration of a gaming machine 722 is illustrated in FIG. 7. As illustrated, the gaming machine 722 generally comprises a housing or cabinet 726 for supporting and/or enclosing various components required for operation of the gaming machine. In the embodiment illustrated, the housing 726 includes a door located at a front thereof, the door capable of being moved between an open position which allows access to the interior, and a closed position in which access to the interior is generally prevented. The configuration of the gaming machine 722 may vary. In the embodiment illustrated, the gaming machine 722 has an "upright" configuration. However, the gaming machine 722 could have other configurations, shapes or dimensions (such as being of a "slant"-type, "bar-top" or other configuration as is well known to those of skill in the art).

The gaming machine 722 preferably includes at least one first display device 728 configured to display game information. The display device 728 may comprise an electronic video display such as a cathode ray tube (CRT), high resolution flat panel liquid crystal display (LCD), projection LCD, plasma display, field emission display, digital micromirror display (DMD), digital light processing display (DLP), LCD touchscreen, a light emitting display (LED) or other suitable displays now known or later developed, in a variety of resolutions, sizes and formats (e.g. 4:3, widescreen or the like). As one example, the display might comprise a 19" monitor from iBase (www.ibase.com.tw; Taipei, Taiwan, R.O.C.). The display device 728 may be capable of projecting or displaying a wide variety of information, including images, symbols and other indicia or information associated with game play, game promotion or other events. The gaming machine 722 might include more than one display device, such as a main or first display device 28 and a secondary display device. The two or more display devices might be associated with the housing or the gaming machine 722 might also include a top box or other portion which includes the one or more second display devices. Also, the gaming machine 722 might include side displays (such as mounted to the exterior of the housing 726) and might include multiple displays of differing sizes.

The gaming machine 722 is preferably configured to present one or more games upon a player making a monetary payment or wager. In this regard, as described in more detail below, the gaming machine 722 includes mechanism or means for accepting monetary value.

In one embodiment, as noted above, certain base game outcomes and side bet outcomes (but preferably not all outcomes) may be designated as winning outcomes (the non-winning outcomes may be referred to as losing outcomes) and awards may be provided for winning outcomes, such as monetary payments (or representations thereof, such as prize of credits) as detailed herein. As detailed below, the gaming machine 722 preferably includes a mechanism or means for returning unused monetary funds and/or dispensing winnings to a player.

The gaming machine 722 preferably includes one or more player input devices 730 (such as input buttons, plunger mechanisms, a touch-screen display, joystick, touch-pad or the like). These one or more devices 730 may be utilized by the player to facilitate game play, such as by providing input or instruction to the gaming machine 722. For example, such input devices 730 may be utilized by a player to place a wager, cause the gaming machine 22 to initiate a game, to "cash out" of the gaming machine, or to provide various other inputs.

In one preferred embodiment, the gaming machine 722 includes at least one microprocessor or controller for controlling the gaming machine, including receiving player input and sending output signals for controlling the various components or peripheral devices of the machine 722 (such as generating game information for display by the display devices). One example of a controller 134 is a Kontron KTQ87/mITX embedded Mini-ITX Motherboard with Intel Z87 Chipset and $4^{th}$ Generation Intel 17/5/13 Dual and Quad Core CPUs (www.kontron.com; Augsburg, Germany). The controller may be arranged to receive information regarding funds provided by a player to the gaming machine 722, receive input such as a purchase/bet signal when a purchase/bet button is depressed, and receive other inputs from a player. The controller may be arranged to generate information regarding a game, such as generating game information for display by the at least one display device (such as information comprising playing cards which are dealt to the player hand and the banker hand, as described above), for determining winning or losing game outcomes and for displaying information regarding awards for winning game wagers and side bets, among other things.

The controller may be configured to execute machine readable code or "software" or otherwise process information, such as obtained from a remote server. Software or other instructions may be stored at a memory or data storage device, e.g. in a fixed or non-transitory configuration. The memory may also store other information or data, such as data stored in table or other forms (including, but not limited to look-up tables, pay tables and other information including tracked game play information). The gaming machine 722 may also include one or more random number generators for generating random numbers (such as implemented by a random number generator software module stored in the memory and executable by the processor), such as for use in selecting playing cards and for presenting the game in a random fashion (e.g. whereby the game is presented in a manner in which the player cannot control the outcome) or pseudo-random fashion (e.g. such as where the game includes a skill component which can affect the outcome of the game). One embodiment of a random RNG engine, RNGCryptoServiceProvider Class, by Microsoft, is set forth below in Table 2.

TABLE 2

```
Language: c# .net
Code snippet:
  //
  // Summary:
  //   Fills an array of bytes with a cryptographically strong sequence
```

TABLE 2-continued

```
of random values.
    //
   // Parameters:
    // data:
     //      The array to fill with a cryptographically strong sequence
of random values.
     //
     // Exceptions:
     //   T:System.Security.Cryptography.CryptographicException:
     //      The cryptographic service provider (CSP) cannot be acquired.
     //
     //   T:System.ArgumentNullException:
     //      data is null.
  static RNGCryptoServiceProvider_crypto = new
  RNGCryptoServiceProvider();
  var bytes = new byte[1];
  _crypto.GetBytes(bytes);
```

Preferably, the controller is configured to execute machine readable code or instructions (e.g. software) which are configured to implement the game. In this regard, the gaming machine 722 is specially configured to present the game of the invention via specific software and/or hardware which causes the gaming machine to operate uniquely. For example, the controller of the gaming machine 722 may be configured to detect a wager, such as a signal from a player's depressing of the "bet one" button. Upon such an event and/or the player otherwise signaling the gaming machine to present the game, the controller may be configured to cause the at least one display 728 to display unique information, such as a unique graphical interface or unique game display, including game symbols (such as images of cards) or other game information. The controller may accept input from a player of game inputs via the one or more player input devices of the gaming machine 722. As indicated above, the machine readable code may be configured in various manners, such as by having various "modules" of software which are designed to implement specific features of the game play or game presentation.

The gaming machine 722 may be configured to generate and present games in a stand-alone manner or it may be in communication with one or more external devices or systems at one or more times. The gaming machine 722 might communicate with one or more of such external devices or systems via one or more communication ports or other interface devices. These ports or interface devices may be configured to implement various communication protocols (including proprietary protocols) and communicate via wireless, wired or other communication link. For example, the gaming machine 722 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 722 is configured to present one or more wagering games. The gaming machines 722 is preferably configured to accept value, such as in the form of coins, tokens, paper currency or other elements or devices representing value such as monetary funds. Thus, as indicated above, the gaming machine 722 preferably includes a mechanism or means for accepting monetary value. For example, the gaming machine 722 might include a coin acceptor 732 for accepting coins. Of course, associated coin reading/verifying devices and coin storage devices may be associated with the gaming machine 722 if it is configured to accept coins. Likewise, the gaming machine 722 might include a media reader 734. Such a reader may be configured to accept and read/verify paper currency and/or other media such as tickets. Of course, in such event the gaming machine 722 may further be configured with one or more paper currency or ticket storage devices, such as cash boxes, and other paper currency or media handling devices (including transport devices).

The gaming machine 722 might also be configured to read FOBs, magnetic stripe cards or other media having data associated therewith and via which value or funds may be associated with the gaming machine 722. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications, such as to enable the transfer of funds from the player to the gaming machine or system.

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). Such wager input options may allow the player to wager on the base game and optionally place the side bet in accordance with the present invention. In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 722 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 722 to indicate their desire to cash out, such as by selecting a "cash out" button or touch screen feature or providing other input. In response, a monetary value represented by the player's credit balance or the like is preferably paid, transferred or otherwise provided to the player. For example, upon an award or at cash-out, associated funds may be paid to the player by the gaming machine 722 dispensing coins to a coin tray 740. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In this regard, the gaming machine 722 may include one or more media printers or writers 48. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 722 may also include a player tracking device, such as a card reader 766 and/or an associated keypad 770 or other input device (such as a touch screen display). Such player tracking devices are well known and may permit the game operator to track play of players of the gaming machine. The tracked play may be utilized to offer player bonuses or awards.

The main game controller or processor may communicate with several of the peripheral devices via one or more intermediary controllers. For example, some of the peripheral devices might comprise USB type or enabled devices which are controlled by an intermediary USB controller.

A casino may have numerous such gaming machines 722, such as located on a casino floor or in other locations. Of course, such gaming machines 722 might be used in other environments, such as an airport, a bar or tavern or other locations.

It will be appreciated that the gaming machine illustrated in FIG. 7 is only exemplary of one embodiment of a gaming machine. For example, it is possible to for the gaming machine to have various other configurations, including different shapes and styles and having different components than as just described.

For example, instead of comprising a "casino"-style gaming machine, it is possible for the game of the invention to be presented on a computing device, including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays.

The gaming machine 722 may, as noted above, be part of a system which includes other devices. For example, the gaming machine 722 may communicate with one or more casino systems, such as a player tracking server or system, an accounting system or server, a ticketing system, a bonusing system, a tournament system, other gaming machines, and external devices.

Such a gaming machine 722 might be used, for example, to present the above-referenced game to one or more players in a configuration where the dealer is essentially automated.

In a preferred embodiment, the game is played or presented as a multi-player game to two or more players. In an embodiment where the game is presented at a gaming table, the multiple players may play the game via that single table. In an electronic gaming device configuration, two or more players might play the game as presented to them at different gaming devices, such as coordinated through a central server. In yet other embodiments, it is possible to play or present the game as a single player game, either at a table or gaming device.

The game, gaming devices and systems of the invention have various advantages. One advantage of the invention a game having blackjack game type features, but which is improved to address shortcomings of standard blackjack games. In particular, unlike standard blackjack games where a separate player hand is dealt to each player to play against the dealer, in the present invention a single banker hand and a single player hand are dealt. In accordance with the invention, all players place a wager on either the player hand or the banker hand. An advantage of this aspect of the invention is that it streamlines presentation of the game because only a single player hand needs to be dealt. In addition, player comradery is generated in a blackjack type game because multiple players may place a wager on the same hand and thus collectively root for that hand to be winning.

The game also offers exciting side bets which are easy to resolve and increase the opportunity for the player to receive large winnings.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of presenting a wagering game to a plurality of players comprising the steps of:

providing a gaming table having a playing surface and a game layout;

receiving, via at least one input device of said gaming table, player input of a game wager upon either a banker hand or a player hand from each player;

dealing an initial two card player hand and an initial two card banker hand;

determining if either or both of said initial two card player hand and said initial two card banker hand comprise a blackjack;

when either said initial two card player hand or said initial two card banker hand comprise a blackjack, determining an outcome of said game with reference to said initial two card banker hand and said initial two card player hand and resolving said game wager of each player based upon said determined outcome;

when neither said initial two card player hand or said initial two card banker hand comprise a blackjack, completing said initial two card player hand and said initial two card banker hand into a final player hand and a final banker hand according to one or more predefined rules regarding the dealing of additional cards to said initial player hand and initial banker hand, determining an outcome of said game with reference to said final player hand and said final banker hand by at least determining which of said final player hand or final banker hand has a point total closest to or equal to 21, without exceeding 21, and resolving said game wager of each player based upon said determined outcome, except that if said final player hand and final banker hand each have the same point total of 21 or less, declaring the outcome as a push; and wherein the step of resolving said game wager of each player based upon said determined outcome comprises:

a) returning each player's game wager in the event said outcome is determined to be a push;

b) paying winnings to each player who placed a game wager on a winning player hand and collecting the game wager of each player who placed a game wager on a losing banker hand;

c) unless a winning banker hand is a three card hand with a point total of 17, paying winnings to each player who placed a game wager on a winning banker hand and collecting the game wager of each player who placed a game wager on a losing player hand; and (d) if the winning banker hand is a three card hand with a point total of 17, returning the game wager to each player who placed a game wager on the winning banker hand.

2. The method in accordance with claim 1 wherein:

when said initial two card player hand comprises a blackjack and said initial two card banker hand does not, determining said player hand to be winning;

when said initial two card banker hand comprises a blackjack and said initial two card player hand does not, determining said banker hand to be winning; and when both said initial two card banker hand and said initial two card player hand comprise blackjacks, determining said outcome to comprise a push.

3. The method in accordance with claim 1 further comprising accepting a first optional side bet from at least one of said plurality of players and awarding winnings to said at least one player from whom a first side bet is accepted if said final banker hand is winning, has three cards and a point total of 17.

4. The method in accordance with claim 3 further comprising accepting a second optional side bet from at least one of said plurality of players and awarding winnings to said at least one player from whom a second side bet is accepted if said player's hand is winning and a point differential between said final banker hand and said final player hand is a predetermined value.

5. The method in accordance with claim 4 wherein said game layout includes a player area corresponding to each of said plurality of players, each player area comprising a banker hand wagering area, a player hand wagering area, a first side bet wagering area and a second side bet wagering area.

6. The method in accordance with claim 5 wherein said step of receiving, via at least one input device of said gaming table, player input of a game wager comprises detecting a wager placed at either said player hand wagering area or said banker hand wagering area, and said step of accepting a first optional side bet comprises detecting a wager placed at said first side bet wagering area and said step of accepting a second optional side bet comprises detecting a wager placed at said second side bet wagering area.

7. The method in accordance with claim 1 wherein said predefined rules comprise, as to said player hand:

when the player hand has a point total of 2-11, and the player hand has not drawn out to 4 cards, the player hand will always receive a card, wherein if the hand contains an Ace, the Ace will be counted as 1 if the point total of the hand, with the Ace counting as 1, is 6 or less, and the Ace will be counted as 11 if the point total of the hand, with the Ace counting as 1, is 7 or greater;

when the player hand has a point total of 12-16 and the player hand has not drawn out to 4 cards the player hand will:

receive a card if the banker hand has a point total of 17 or higher; and stand if the banker hand has a point total of 16 or under; and when the player hand has a point total of 17 or above, or the player hand has drawn out to 4 cards, the player hand will stand.

8. The method in accordance with claim 7 wherein said predefined rules comprise, as to said banker hand:

when the banker hand has a point total of 2-16 and has not drawn out to 4 cards, and when the player hand has a point total under 21, the banker hand will receive a card; and when the banker hand has a point total of 17 or higher, or has drawn out to 4 cards, or the player hand has a point total of at or over 21, the banker hand will stand.

9. An electronic gaming device configured to present a wagering card game to at least one player comprising:

a monetary funds accepting mechanism for accepting monetary funds in creating a player credit balance;

at least one electronic display device;

at least one player input receiving device;

a memory device;

a controller; and machine-readable code stored in said memory device and executable by said controller to cause said controller to accept input from said player via said at least one player input device of a game wager upon either a player hand or a banker hand from said player credit balance;

machine-readable code stored in said memory device and executable by said controller to cause said controller to cause said at least one electronic display device to display an initial two card player hand and an initial two card banker hand;

machine-readable code stored in said memory device and executable by said controller to cause said controller to determine if either or both of said initial two card player hand and said initial two card banker hand comprise a blackjack;

machine-readable code stored in said memory device and executable by said controller to cause said controller to, when either said initial two card player hand or said initial two card banker hand comprise a blackjack, determine an outcome of said game with reference to said initial two card banker hand and said initial two card player hand and resolve said game wager of said player based upon said determined outcome;

machine-readable code stored in said memory device and executable by said controller to cause said controller to, when neither said initial two card player hand or said initial two card banker hand comprise a blackjack, complete said initial two card player hand and said initial two card banker hand into a final player hand and a final banker hand according to one or more predefined rules regarding the dealing of additional cards to said initial player hand and initial banker hand, cause said at least one electronic display device to display said final player hand and said final banker hand, to determine an outcome of said game with reference to said final player hand and said final banker hand, the outcome being determined by which of said final player hand or final banker hand has a point total closest to or equal to 21, without exceeding 21, and resolve said game wager of said player based upon said determined outcome, except that if said final player hand and final banker hand each have the same point total of 21 or less, determining the outcome to be a push; and wherein said machine-readable code stored in said memory device and executable by said controller is configured to cause said controller to resolve said game wager of each player to:

a) return each player's game wager in the event said outcome is determined to be a push;

b) pay winnings to each player who placed a game wager on a winning player hand and collect the game wager of each player who placed a game wager on a losing banker hand;

c) unless a winning banker hand is a three card hand with a point total of 17, pay winnings to each player who placed a game wager on a winning banker hand and collect the game wager of each player who placed a game wager on a losing player hand; and d) if the winning banker hand is a three card hand with a point total of 17, return the game wager to each player who placed a game wager on the winning banker hand.

10. The electronic gaming device in accordance with claim 9 wherein said machine-readable code stored in said memory device is executable by said controller to cause said controller to:

when said initial two card player hand comprises a blackjack and said initial two card banker hand does not, determine said player hand to be winning;

when said initial two card banker hand comprises a blackjack and said initial two card player hand does not, determine said banker hand to be winning; and when both said initial two card banker hand and said initial two card player hand comprise blackjacks, determine said outcome to comprise a push.

11. The electronic gaming device in accordance with claim 9 further comprising machine-readable code stored in said memory device and executable by said controller to cause said controller to accept a first optional side bet from at least one of said players and award winnings to said at least one player from whom a first side bet is accepted if said final banker hand is winning, has three cards and a point total of 17.

12. The electronic gaming device in accordance with claim 11 further comprising machine-readable code stored in said memory device and executable by said controller to cause said controller to accept a second optional side bet from at least one of said players and award winnings to said at least one player from whom a second side bet is accepted if said player's hand is winning and a point differential between said final banker hand and said final player hand is a predetermined value.

13. The electronic gaming device in accordance with claim 9 wherein said predefined rules comprise, as to said player hand:

when the player hand has a point total of 2-11, and the player hand has not drawn out to 4 cards, the player hand will always receive a card, wherein if the hand contains an Ace, the Ace will be counted as 1 if the point total of the hand, with the Ace counting as 1, is 6 or less, and the Ace will be counted as 11 if the point total of the hand, with the Ace counting as 1, is 7 or greater;

when the player hand has a point total of 12-16 and the player hand has not drawn out to 4 cards the player hand will:

receive a card if the banker hand has a point total of 17 or higher; and stand if the banker hand has a point total of 16 or under; and when the player hand has a point total of 17 or above, or the player hand has drawn out to 4 cards, the player hand will stand.

14. The electronic gaming device in accordance with claim 9 wherein said predefined rules comprise, as to said banker hand:

when the banker hand has a point total of 2-16 and has not drawn out to 4 cards, and when the player hand has a point total under 21, the banker hand will always receive a card; and when the banker hand has a point total of 17 or higher, or has drawn out to 4 cards, or the player hand has a point total of or over 21, the banker hand will stand.

* * * * *